US009267296B2

(12) United States Patent
Maurer et al.

(10) Patent No.: US 9,267,296 B2
(45) Date of Patent: Feb. 23, 2016

(54) MULTI-TILE ROOFING OR SIDING SYSTEM

(71) Applicant: Tapco International Corporation, Wixom, MI (US)

(72) Inventors: Michael W. Maurer, Walled Lake, MI (US); Matthew Jason Michalski, Sylvan Lake, MI (US); Nathan D. Greenway, Attica, MI (US); Clyde G. Allen, Columbiaville, MI (US); Matthew M. Jackson, Saline, MI (US)

(73) Assignee: Tapco International Corporation, Wixom, MI (US)

( * ) Notice: Subject to any disclaimer, the term of this patent is extended or adjusted under 35 U.S.C. 154(b) by 0 days.

(21) Appl. No.: 14/297,538

(22) Filed: Jun. 5, 2014

(65) Prior Publication Data

US 2015/0354229 A1 Dec. 10, 2015

(51) Int. Cl.
*E04F 13/08* (2006.01)
*E04D 13/04* (2006.01)

(52) U.S. Cl.
CPC ..... *E04F 13/0894* (2013.01); *E04D 13/04* (2013.01); *E04F 13/0869* (2013.01)

(58) Field of Classification Search
CPC ... E04F 13/0894; E04F 13/0869; E04D 13/04
USPC ..... 52/302.1, 519, 523–526, 533, 536, 538, 52/539
See application file for complete search history.

(56) References Cited

U.S. PATENT DOCUMENTS 885,663 A * 4/1908 Bruzaud ..... 52/538
2,188,445 A * 1/1940 Saxe ..... 403/230
2,482,835 A * 9/1949 Bremer ..... 52/533
2,664,056 A * 12/1953 Ronzone ..... 52/526
2,766,706 A * 10/1956 Ludowici ..... 52/533
2,811,118 A * 10/1957 Ball ..... 52/534
3,220,150 A * 11/1965 Besse ..... 52/538
3,309,831 A * 3/1967 Misch et al. ..... 52/546
3,347,001 A * 10/1967 Cosden ..... 52/105
3,579,940 A * 5/1971 Greenleaf ..... 52/542
3,848,383 A * 11/1974 Wilson et al. ..... 52/533
3,862,532 A * 1/1975 Markos ..... 52/521
4,450,665 A * 5/1984 Katz ..... 52/522
4,522,002 A * 6/1985 Davis et al. ..... 52/309.1
4,680,911 A * 7/1987 Davis et al. ..... 52/521
4,731,969 A * 3/1988 Baker et al. ..... 52/536

(Continued)

FOREIGN PATENT DOCUMENTS

DE 4327789 A1 * 2/1994 ..... E04D 1/04
DE 4327793 A1 * 2/1994 ..... E04D 1/04
DE 102009013194 A1 * 8/2010 ..... E04D 1/04

*Primary Examiner* — James Ference
*Assistant Examiner* — Charissa Ahmad
(74) *Attorney, Agent, or Firm* — Quinn Law Group, PLLC

(57) ABSTRACT

A multi-tile system for attachment to a mounting surface is provided. Each of the tiles includes an upper edge configured to be oriented upward relative to the mounting surface and a lower edge configured to be oriented downward relative to the mounting surface. The tiles include a receiving member formed on an exterior side of the upper edge and a locking member formed on an interior side of the lower edge. The receiving member of the tile is configured to interlock with the locking member of an adjacent tile to limit movement of the lower edge of one tile away from the upper edge of the other tile. The receiving member and the locking member are configured to define a vertical range of continuous vertical adjustment between adjacent tiles.

9 Claims, 5 Drawing Sheets

(56) References Cited

U.S. PATENT DOCUMENTS

| | | | | | |
|---|---|---|---|---|---|
| 4,890,432 | A * | 1/1990 | Shepherd | 52/314 | |
| 5,174,092 | A * | 12/1992 | Naden | 52/553 | |
| 5,224,318 | A * | 7/1993 | Kemerer | 52/521 | |
| 5,295,339 | A | 3/1994 | Manner | | |
| 5,537,792 | A * | 7/1996 | Moliere | 52/531 | |
| 5,581,968 | A * | 12/1996 | Laurie et al. | 52/538 | |
| 5,644,886 | A * | 7/1997 | Ekmark | E04D 3/30 | 52/518 |
| 5,878,543 | A * | 3/1999 | Mowery | E04F 13/0864 | 52/519 |
| 6,336,303 | B1 * | 1/2002 | Vandeman et al. | 52/520 | |
| 6,955,019 | B2 * | 10/2005 | Donlin et al. | 52/520 | |
| 7,240,461 | B1 * | 7/2007 | Vandeman et al. | 52/539 | |
| 7,845,141 | B2 | 12/2010 | Martinique | | |
| 8,359,804 | B2 | 1/2013 | Wakefield | | |
| 8,402,707 | B2 * | 3/2013 | Mitchell et al. | 52/288.1 | |
| 8,407,962 | B2 * | 4/2013 | Cahill | E04F 13/0864 | 52/520 |
| 2004/0226225 | A1 * | 11/2004 | Olk et al. | 52/58 | |
| 2007/0011966 | A1 | 1/2007 | Justice et al. | | |
| 2008/0184645 | A1 * | 8/2008 | Trabue et al. | 52/525 | |
| 2008/0307738 | A1 | 12/2008 | Lorenzon | | |
| 2010/0132295 | A1 * | 6/2010 | Bootier et al. | 52/520 | |

* cited by examiner

MULTI-TILE ROOFING OR SIDING SYSTEM

TECHNICAL FIELD

This disclosure relates to multi-tile roofing or siding systems for attachment to mounting surfaces.

BACKGROUND

Exterior siding or roofing systems may include a plurality of tiles, panels, or combinations thereof. Generally, tiles simulate one or two individual decorative units while panels simulate a greater number of individual decorative units. For example, tiles or panels may emulate wooden shakes, wooden shingles, or slate tiles. However, the decorative units may be formed to simulate other siding or roofing materials, including stone, ceramics, et cetera.

SUMMARY

A multi-tile system for attachment to a mounting surface is provided. Each of the tiles includes an upper edge configured to be oriented upward relative to the mounting surface and a lower edge configured to be oriented downward relative to the mounting surface.

The tiles also include a receiving member formed on an exterior side of the upper edge and a locking member formed on an interior side of the lower edge. The receiving member of one tile is configured to interlock with the locking member of an adjacent tile to limit movement of the lower edge of the adjacent tile away from the upper edge of the first tile. Furthermore, the receiving member and the locking member are configured to define a vertical range of continuous vertical adjustment between adjacent tiles.

The above features and advantages, and other features and advantages, of the present disclosure are readily apparent from the following detailed description of some of the best modes and other embodiments for carrying out the invention, which is defined solely by the appended claims, when taken in connection with the accompanying drawings.

DETAILED DESCRIPTION

Figure 1:
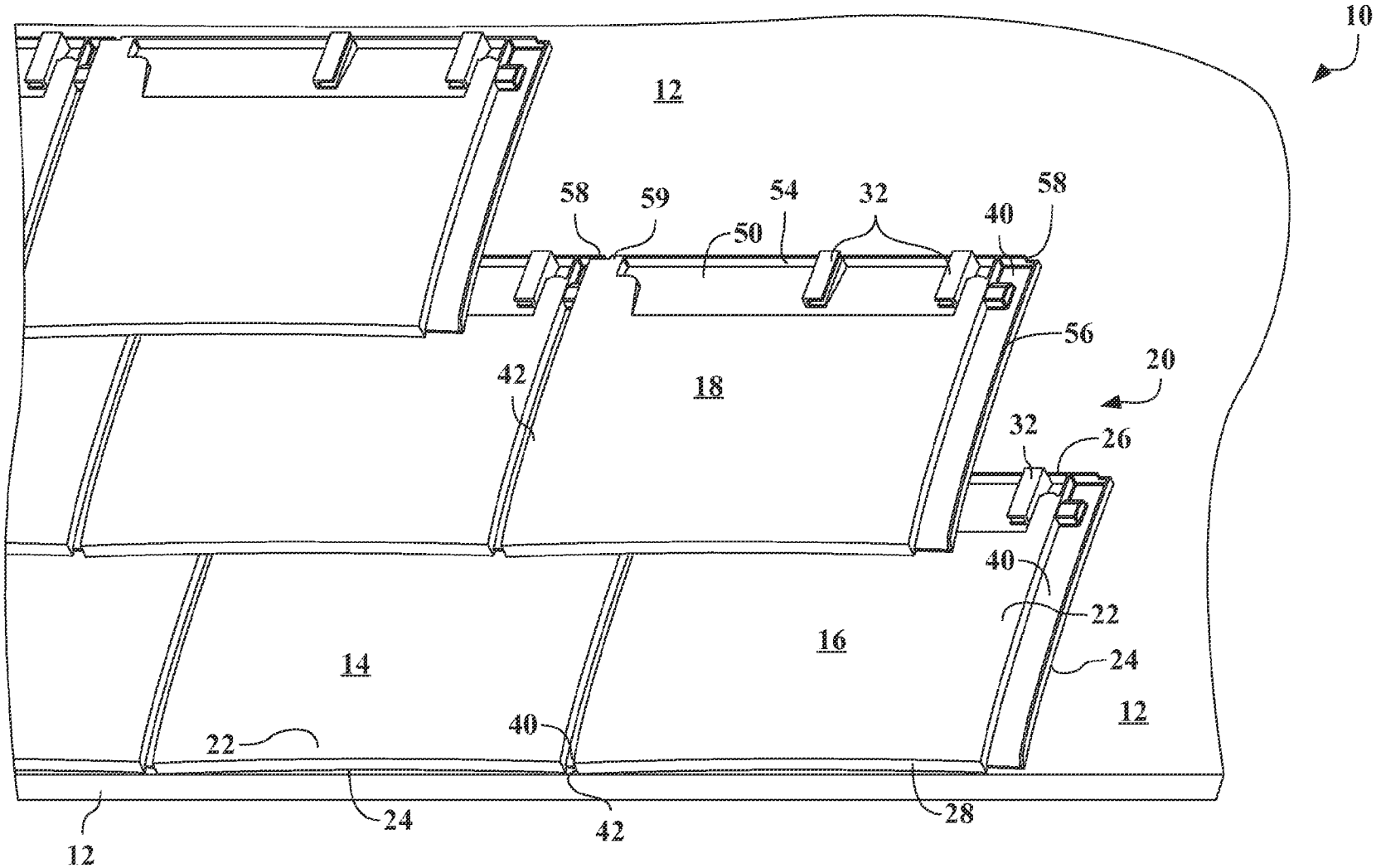
FIG. 1 is a schematic isometric view of a roofing system having a plurality of tiles.

Referring to the drawings, like reference numbers correspond to like or similar components wherever possible throughout the several figures. There is shown in FIG. 1 a roofing system or multi-tile system 10 for attachment to a mounting surface 12. The multi-tile system 10 may be attached to either roofs, vertical walls, or angled walls, such that the mounting surface 12 may be a wall or a roof.

The roofing system or multi-tile system 10 includes at least a first tile 14, a second tile 16, and a third tile 18. The second tile 16 and the third tile 18 have similar features to the first tile 14, such that they may be referred to collectively or generically as tiles 20.

An exterior side 22 of the tiles 20, which faces outward and away from the mounting surface 12, defines a forward direction or exterior face. An interior side 24 of the tiles 20, which faces downward toward the mounting surface 12, defines a rearward direction or interior face.

While the present subject matter may be described with respect to specific applications or industries, those skilled in the art will recognize broader applicability. Those having ordinary skill in the art will recognize that terms such as "above," "below," "upward," "downward," et cetera, are used descriptively of the figures, and do not represent limitations on the scope of the invention, as defined by the appended claims, unless stated otherwise. Any numerical designations, such as "first" or "second" are illustrative only and are not intended to limit the scope of the invention in any way.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

Figure 2:
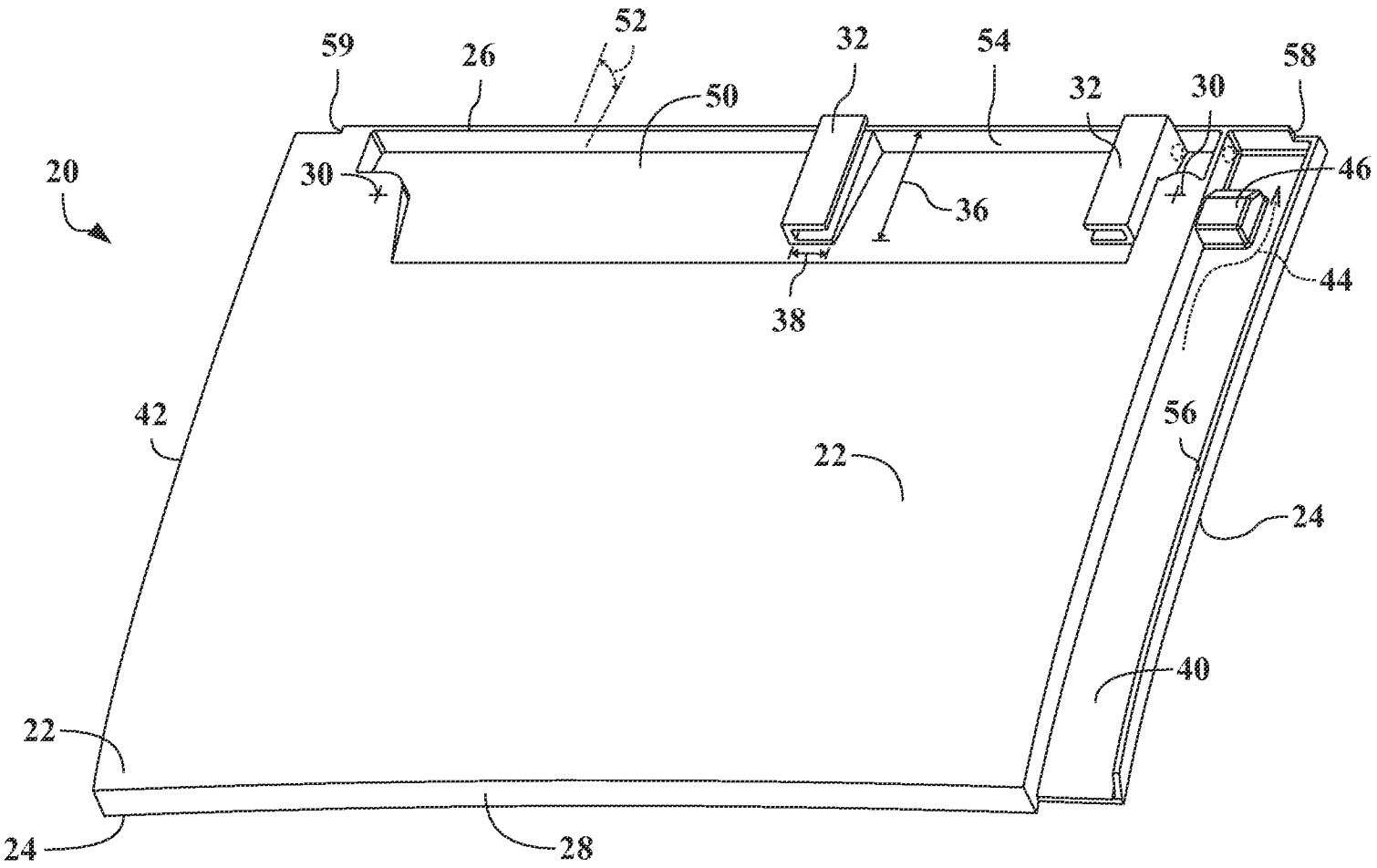
FIG. 2 is a schematic isometric view of an exterior side of one of the tiles shown in FIG. 1.
Figure 3:
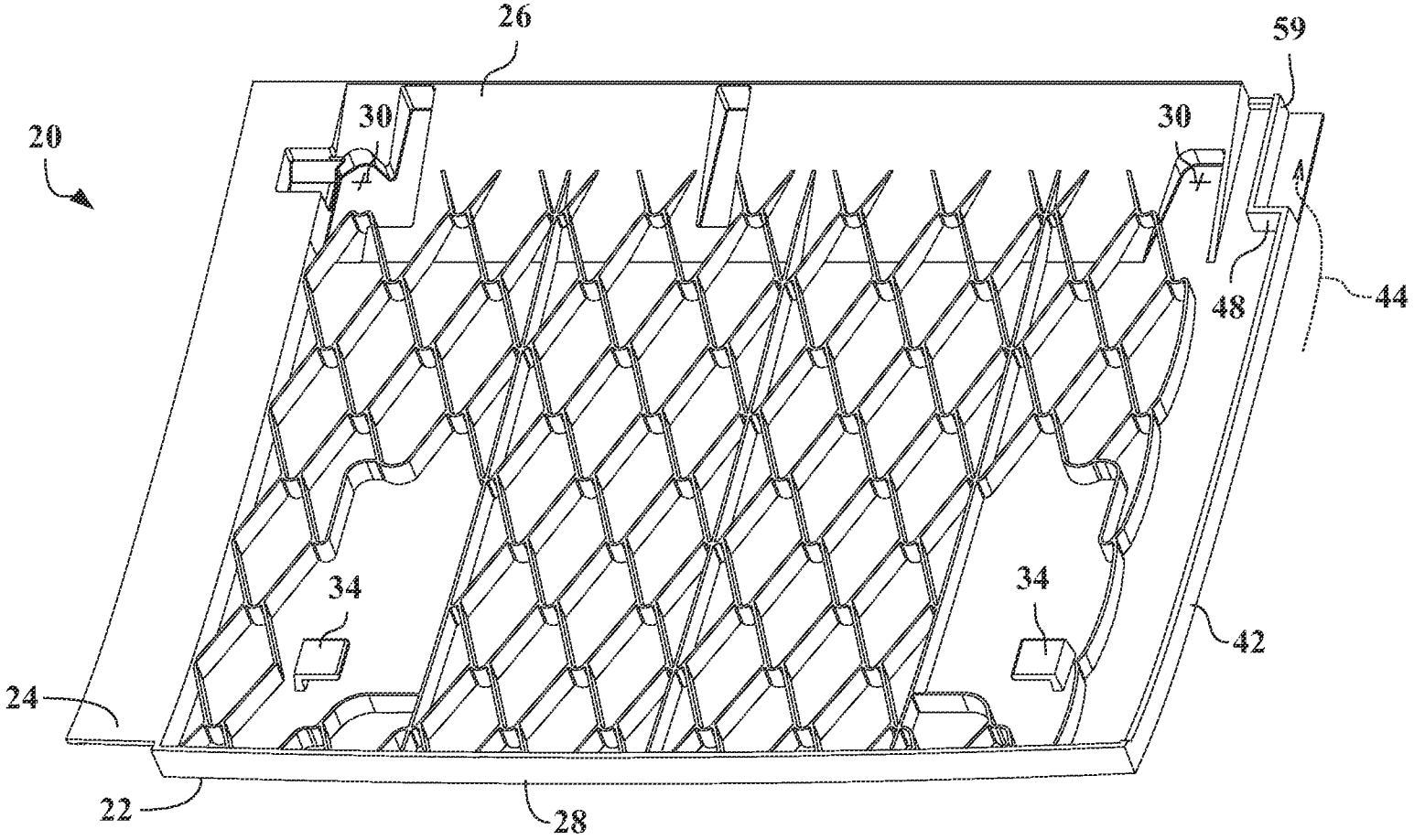
FIG. 3 is a schematic isometric view of an interior side of one of the tiles shown in FIG. 1.

Referring also to FIG. 2 and to FIG. 3, and with continued reference to FIG. 1, there are shown two schematic isometric views of tiles 20. Features of the first tile 14, the second tile 16, and the third tile 18 will be described with reference to FIG. 1, FIG. 2, and FIG. 3. The described features of the tile 20 shown in FIGS. 2 and 3 may refer to any of the first tile 14, the second tile 16, or the third tile 18. Note that manufacturing variance may lead to natural differences between the tiles 20 that are otherwise intended to be identical.

FIG. 2 shows the exterior side 22 of one of the tiles 20, and FIG. 3 shows the interior side 24 of one of the tiles 20. When assembled to the mounting surface 12, the exterior sides 22 and the interior sides 24 of the tiles 20 (as viewed in FIGS. 2 and 3, respectively) cooperate to lock the tiles 20 to the mounting surface with the assistance of one or more fasteners (not shown).

The tiles 20 include a fastener edge, upper portion, or upper edge 26 defined along one edge, which is shown on the top in FIGS. 2 and 3. A lap edge, lower portion, or lower edge 28 is defined opposite the upper edge 26, and is shown on a bottom or lower edge in FIGS. 2 and 3. The upper edge 26 may also be referred to as the head of the tile 20 and is lapped or overlapped by the lower edge 28 of subsequent tiles.

The exterior side 22 includes a face or fascia of the tiles 20. The face may be textured, painted, or surface-treated to simulate the look of different roofing materials. In many configurations of the tiles 20, the face will be configured to simulate the aesthetic look of slate, such that the multi-tile system 10 emulates natural slate roofing. However, the exterior sides 22 of the tiles 20 may also be configured to emulate other materials, such as, for example and without limitation: wooden shakes, wooden shingles, or ceramic tiles.

References to upper and lower directions, regions, or portions are generally defined relative to gravity and elevation as the tiles 20 are intended to be assembled to the mounting surface 12. Therefore, the typical flow direction of water or moisture over the tiles 20 and the structures to which they are mounted (although wind may cause water to move against gravity) is from the upper edge 26 toward the lower edge 28—i.e., top down. Similarly, vertical and horizontal are used descriptively relative to gravity and elevation. Horizontal is generally parallel to gravity and does not involve a change in elevation, while vertical is generally perpendicular to the horizontal direction and does involve a change in elevation.

At least some portion of the upper edge 26 contacts the mounting surface 12, possibly with an intermediary water barrier disposed therebetween. The upper edge 26 has a plurality of fastener holes 30 or fastener points defined therein.

The fastener holes 30 are configured to mount the tiles 20 to the mounting surface 12 with the fasteners, which may be nails, screws, staples, et cetera. In some embodiments, the fastener holes 30 may not be fully defined through the upper edge 26 but may instead be areas designated or identified for piercing by the fasteners, such that the fasteners at least partially pierce the material forming the tiles 20. Furthermore, the heads of the fasteners may stop at the face of the tile 20, as opposed to plunging into the face of the tile 20 or setting within a recess formed into the face of the tile 20.

The tiles 20 may be formed from different polymeric or composite materials. For example, and without limitation, the tiles 20 may be formed from polymers, reinforced resin, polypropylene, foamed polypropylene, high density polyethylene, low density polyethylene, combinations thereof, or other suitable materials. In many configurations, the tiles 20 may be formed as unitary, one-piece components, such that each tile 20 is a single component formed from a single piece of material without subsequent attachment of pieces formed separately. The tiles 20 may be formed via injection molding, compression molding, machining, or other suitable processes.

As best viewed in FIG. 3, the interior side 24 includes a system of ribs (not separately numbered), including filleted diamonds and vertical cut-line ribs. The filleted diamonds may provide additional structural rigidity and support for impact, such as from hail. Additionally, the filleted diamonds may prevent or limit movement of gases or liquefied material during extreme temperature events. The cut-line ribs may provide structural rigidity and convenient points for cutting the tiles 20 into partial tiles during installation of the multi-tile system 10, such that gaps on the interior side 24 are not viewable from the edges of partial tiles that are cut along the cut-line ribs.

A receiving member 32 is formed on the exterior side 22 of the upper edge 26, and a locking member 34 is formed on the interior side 24 of the lower edge 28. When the tiles 20 are assembled to the mounting surface 12, the receiving member 32 of a lower course (such as those on either the first tile 14 or the second tile 16 in FIG. 1) is covered or lapped by an upper course (such as the third tile 18).

Courses of tiles 20 refer to patterns or sets used during installation. In the example shown in the figures, each horizontal row is a separate course. A first course, which would include the first tile 14 and the second tile 16 in FIG. 1, is installed on the lowest portion of the mounting surface 12, possibly after installation of a starter strip or other prep structures, and then a second course, which would include the third tile 18 I FIG. 1, is subsequently installed above the first course.

The receiving member 32 of one tile 20, on the lower course, interlocks with the locking member 34 of another tile 20, on the upper course, to limit movement of the lower edge 28 of the upper tile 20 away from the upper edge 26 of the lower tile 20. Alternatively stated, the locking member 34 of the lower edge 28 is held to, or interlocked with, the receiving member 32 of the upper edge 26.

As used herein, interlocking between the receiving member 32 and the locking member 34 refers to at least some overlap between the receiving member 32 and the locking member 34, relative to the mounting surface 12. The receiving member 32 and the locking member 34 shown include cantilevered or overhanging portions, such that an opposing force resists separation of the receiving member 32 and the locking member 34.

Therefore, even though only the upper edges 26 of the tiles 20 are directly fastened to the mounting surface 12, both the lower edge 28 and the upper edge 26 are restrained to the mounting surface 12. Under wind loads that may otherwise pull the lower edge 28 of the tile 20 away from the mounting surface 12, the interlocking between the receiving member 32 and the locking member 34 helps keep all portions of the tiles 20 restrained to the mounting surface 12. These uplift forces are counteracted at the lower edge 28 without any fasteners driven through lower edge 28.

Where the lower course of tiles 20, the horizontal row of FIG. 1 that includes the first tile 14, is the first course assembled to the mounting surface 12, there may also be a starter strip or other structure on the front edge of the mounting surface 12. The starter strip may include a set of receiving members 32 that interface with the locking members 34 of the first course, such that the starter strip emulate the upper portion of a course tiles 20 and interfaces with the first tile 14.

In the configuration shown in the figures, the receiving members 32 and the locking members 34 face inward toward each other and toward the center of the tiles 20. However, the receiving members 32 and the locking members 34 could also face outward.

The receiving members 32 and the locking members 34 are illustrated in the figures as formed from a single, continuous piece with the remainder of the tiles 20. However, in other configurations, either of the receiving members 32 or the locking members 34 could be formed as separate components and then subsequently attached to the remainder of the tiles 20. For example, the receiving members 32 could be formed individually, or as part of a larger piece, which are then snapped, adhered, or fastened to toward the upper edge 26.

Alternatively, the receiving members 32 could be formed attached to the upper edge 26 through a living hinge, and then folded to the positions shown. A living hinge may simplify manufacture of the tiles 20 by removing the need for lifters or retractable elements in the mold apparatus, while still maintaining proper draft in the injection-molding process for the tiles 20. The living hinge configuration may include a strip of material encompassing of the receiving members 32, which would then be nailed to the upper portion 26 as the tile 20 is nailed to the mounting surface 12.

The receiving member 32 and the locking member 34 provide continuous vertical adjustment through a vertical range 36, as opposed to incremental adjustment, such as that provided by boss-and-cavity or peg-and-hole systems. The continuous vertical adjustability of the tiles 20 may give the multi-tile system 10 a more-natural appearance, and provides the ability to adjust to different roof shapes, particularly those with multiple horizontal edges at differing vertical heights. The vertical range 36 provides elevational adjustment between tiles 20.

In the multi-tile system 10 shown, the receiving member 32 and the locking member 34 also cooperate to define a horizontal range 38, which provides continuous horizontal adjustment between the tiles 20. The horizontal range 38 is lesser than the vertical range 36, but still allows installers to vary the distance between adjacent tiles 20. Additional horizontal limitations between adjacent tiles 20 are provided by the interaction between the sides of the tiles 20, as discussed herein. Vertical and horizontal adjustability supports maximum and minimum exposure of the tiles 20, particularly vertical exposure, while maintaining proper lap to promote water flow.

The tiles 20 further include a gutter or water channel 40 formed on at least one side of the tiles 10 between the upper edge 26 and the lower edge 28. A side lap 42 is formed on the opposite side from the water channel 40. The side lap 42 is configured to overlap the water channel 40 of an adjacent tile 20. Interaction between the side lap 42 and the water channel 40 further limits the amount of horizontal adjustability between the tiles 20. When multiple tiles 20 are overlapped, the viewable, or exposed, portion of the water channel 40 forms a keyway between horizontally-adjacent tiles 20.

The tiles 20 include a serpentine path or S-path 44 in the side water channel 40. The S-path 44 forces water moving upward through the water channel 40, which may result from wind, to move around a horizontal dam 46. The S-path 44 reduces the likelihood of water reaching the uppermost edge of the water channel 40 and moving over the upper edge 26 onto the mounting surface 12 by forcing the water to move horizontally. The S-path 44 is a change in momentum of water moving through the water channel 40.

The water channel 40 is continuous and does not include any holes, cracks, or nail points. Therefore, water within the water channel 40 cannot leak out of the water channel 40 without going over a ledge or flowing downward, as intended.

As viewed in FIG. 3, the side lap 42 also includes a horizontal ledge 48 that is configured to extend into the water channel 40 of an adjacent tile 20 to further restrict movement of water upward. The S-path 44 is shown in FIG. 3 to illustrate the general flow path when the tiles 20 are assembled or mated together.

The tiles 20 include a water trough 50 formed or defined on the upper edge 26. The water trough 50 is oriented at a trough angle 52 to the mounting surface 12 or to the exterior side 22 of the tile 20, such that there is no lip or ledge between the water trough 50 and the exterior side 22. The trough angle 52 allows water to flow downward from the water trough 50 onto the face of the exterior side 22 toward the lower edge 28, as opposed to trapping water in the water trough 50. Note that on the tiles 20 illustrated, the fastener points 30 are not formed in, or through, the water trough 50.

The trough angle 52 is configured to be substantially horizontal or flat, relative to gravity, when the tile 20 is assembled to the lowest pitch at which the multi-tile system 10 system is intended to be installed. For example, if the tiles 20 are configured to be installed to a minimum pitch of 3:12, which is three feet of rise per twelve feet of run, the trough angle 52 would be approximately fourteen-degrees. Note that when assembled to a steeper roof pitch, the trough angle 52 will also be steeper relative to gravity and drain more aggressively.

In some configurations of the tiles 20, the water trough 50 may have a flow channel or hole connecting to the water channel 40. This connection may allow water to drain from a least a portion of the water trough 50 into the water channel 40.

The tiles 20 shown include a trough lip 54 at the upper edge of the water trough 50. The trough lip 54 is substantially the full thickness of the tile 20 and may help prevent water, especially wind-blown water, from going over the back or top of the tile 20.

The thickness of the upper edge 26 and the lower edge 28 are substantially equal, such that the tiles 20 shown do not taper. Alternatively, some configurations of the tiles 20 may taper from front to back to reduce the amount of material used in the tile. However, such a taper may limit the depth of the water trough 50 and the height of trough lip 54.

The distance that the water trough 50 extends from the upper edge 26 to the face of the tile 20 may define the maximum vertical exposure of the multi-tile system 10. For example, and without limitation, the tiles 20 may have a vertical height of twelve inches and the water trough 50 may have a vertical length of three inches, such that the maximum vertical exposure of the tiles 20 is nine inches. The tiles 20 of an upper course generally must cover, or lap, the water trough 50 of the course just below.

The trough angle 52 and the height of the trough lip 54—based upon triangle-like geometry—may control the length of the water trough 50 and, therefore, may also control the amount of vertical exposure. Using the examples above, the trough lip 54 would be approximately 0.75 inches from the mounting surface 12 for the fourteen-degree trough angle 52 required for 3:12 roof pitch.

Horizontal adjustability and horizontal exposure may be controlled by the interaction between the water channel 40 and the side lap 42 of adjacent (side lapping) tiles 20. For absolute minimum, the side lap 42 may be pushed all the way through the water channel 40 until the water channel 40 is no longer viewable. However, such minimum exposure would negate the ability of the water channel 40 to emulate the natural keyway between, for example, slate tiles.

The tiles 20 include a channel lip 56 formed on one side of the water channel 40. The channel lip 56 limits the maximum horizontal exposure of the tiles 20 by cooperating with the side lap 42 to prevent pulling the side lap 42 beyond the water channel 40 and leaving a gap between horizontally-adjacent tiles 20.

The channel lip 56 also provides a barrier against which water must move to escape the water channel 40, similar to the function of the trough lip 54. The channel lip 56 and the trough lip 54 illustrated in the figures both provide water barrier features that are substantially perpendicular to the mounting surface, such that they require water to change momentum in order move over the edges of the tiles 20.

In the multi-tile system 10 shown, the tiles 20 include a channel notch 58 formed on the upper portion of the water channel, and a lap notch 59 formed on the upper portion of the side lap 42. The channel notch 58 and the lap notch 59 cooperate to limit the amount of the side lap 42 that can extend or overlap into the water channel 40, and ensure that some portion of the water channel 40 is viewable to simulate the keyway between horizontally-adjacent tiles. Therefore, in the tiles 20 shown, the channel notch 58 and the lap notch 59 define the minimum horizontal exposure by limiting how close adjacent tiles can be properly assembled.

Figure 4A:
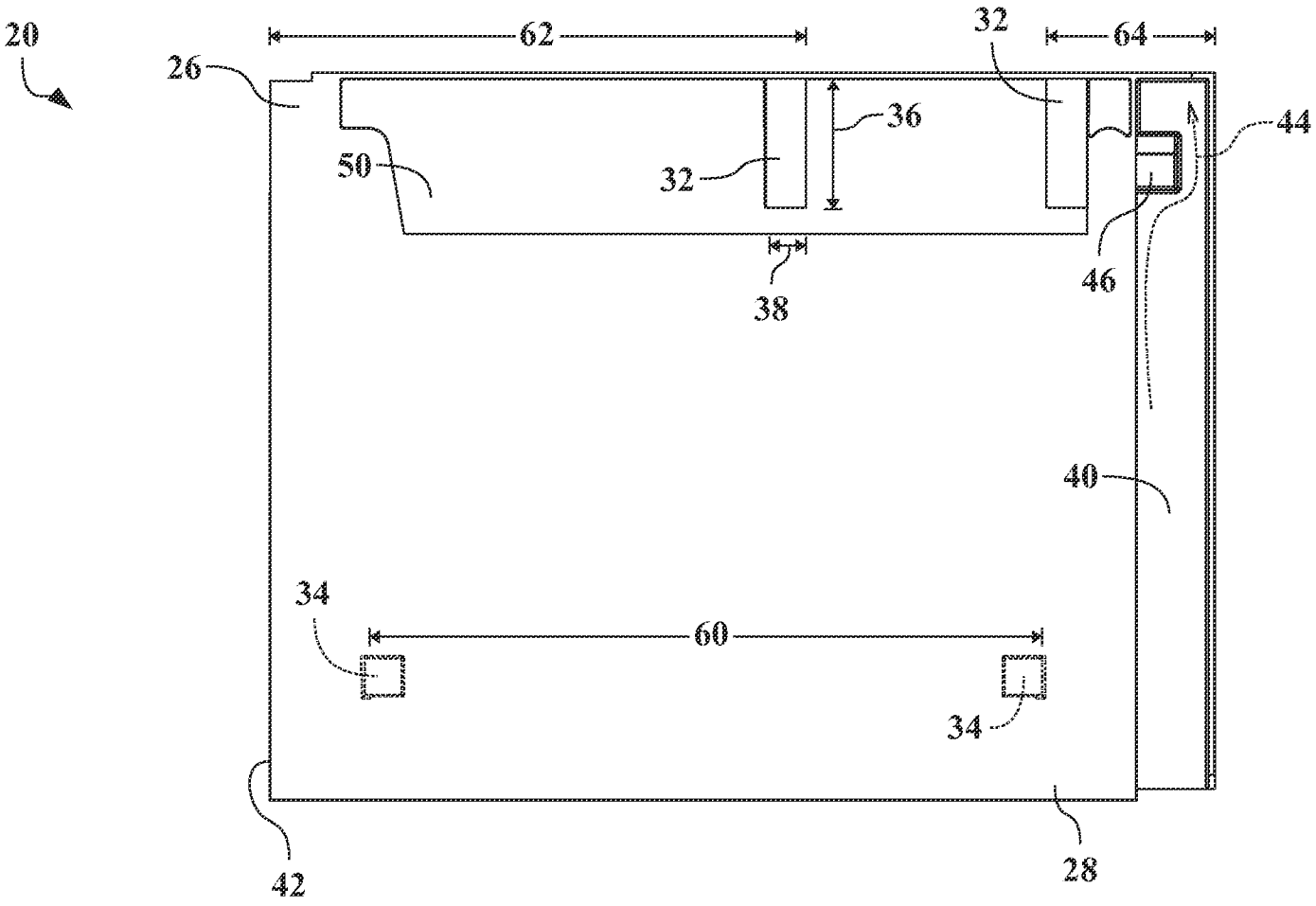
FIG. 4A is a schematic top view of one of the tiles in the roofing system, illustrating alignment of the interlocking features.
Figure 4B:
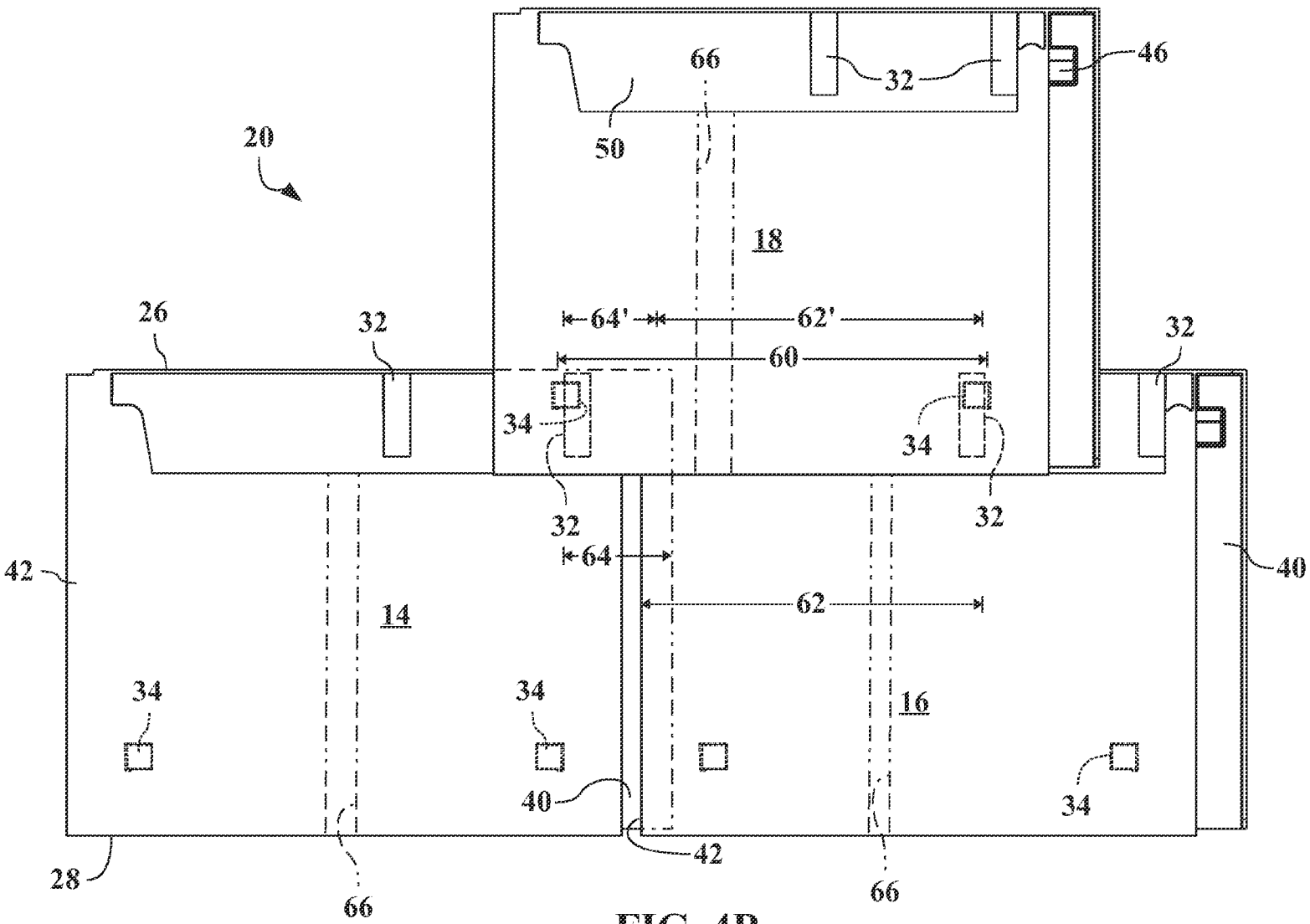
FIG. 4B is a schematic top view illustrating relative alignment of the tiles in the roofing system via interlocking elements.

Referring now to FIG. 4A and to FIG. 4B, and with continued reference to FIGS. 1-3, there are shown additional views of the tiles 20 illustrating alignment and interlocking FIG. 4A shows a top view of one of the tiles 20, and FIG. 4B shows a top view of three tiles 20 aligned with, and assembled to, each other.

The locking members 34 are shown in dashed lines in both FIG. 4A and FIG. 4B. The locking members 34 are spaced apart by a locking span 60. The receiving members 32 are spaced from the edges of the tile 20 by a first offset 62 and a second offset 64.

The locking span 60 is smaller than the first offset 62 and the second offset 64 combined. Therefore, the locking members 34 are spaced at a smaller distance than the receiving members 32 are spaced from the edges of the tile 20, and also a smaller distance than the receiving member 32 of horizontally adjacent tiles 20. However, if the tiles 20 are assembled with proper side lapping, these distances change.

FIG. 4B illustrates proper horizontal and vertical lapping with the first tile 14 and the second tile 16 on the first (lower) course, and the third tile 18 on the second (upper) course. Note that the overlapped portion of the first tile 16 is shown in phantom. As shown in FIG. 4B, when the tiles 20 are assembled with the side lap 42 of the second tile 16 overlapping the water channel 40 of the first tile 14—such that the lower course has proper side lap—the receiving members 32 of the first tile 14 and the second tile 16 are able to interlock with the locking members 34 of the third tile 18. However, if the side lap 42 of the second tile 16 did not properly overlap the water channel 40 of the first tile 14, the locking members 34 of the third tile 18 would not be able to interlock with the receiving members 32 of the first tile 14 and the second tile 16.

The receiving members 32 of the first tile 14 and the second tile 16, both of which are shown in phantom, are spaced apart by a first effective offset 62' and a second effective offset 64'. The first effective offset 62' and the second effective offset 64' are measured from the centerline of the overlap between the first tile 14 and the second tile 16.

Therefore, as shown in FIG. 4B, the locking span 60 of the third tile 18 is greater than the combined offset of the first effective offset 62' and the second effective offset 64', such that the locking members 34 of the third tile 18 can interlock with the receiving members 32 of the first tile 14 and the second tile 16. If the tiles 20 of lower courses are not properly lapped, the tiles 20 of the subsequent courses will not be able to be interlocked with the lower courses because the locking span 60 will be less than the first offset 62 and the second 64 combined.

In FIG. 4B, the tiles 20 are illustrated with maximum, or near maximum, vertical exposure. Therefore, the maximum vertical amount of the first tile 14 and the second tile 16 are viewable below the third tile 18, and the water trough 50 of the first tile 14 is not viewable below the third tile 18.

The water channel 40 and the side lap 42 cooperate to define a viewable keyway between horizontally-adjacent tiles 20, such as that viewable between the first tile 14 and the second tile 16 in FIG. 1 and FIG. 4B. The tiles 20 may also include a simulated keyway 66 formed in the face of the tiles 20, as illustrated in phantom in FIG. 4B. The simulated keyway 66 may be located variably across the exterior side 22 of each the tiles 20, and the width of the simulated keyways 66 may be varied. The simulated keyways 66 may be formed on some, all, or none of the tiles 20.

The location of the receiving members 32 may be adjusted to the left or right of the upper edge 26 of the tiles 20. In the tiles 20 shown, the receiving members 32 are offset relative to the center of the tile 20, but may alternatively be symmetric about the tiles 20.

Using FIG. 1 and FIG. 4B as examples, assembly of the multi-tile system 10 may occur by aligning the first tile 14 to the mounting surface 12. The first tile 14 may be aligned with, for example and without limitation: edges of the mounting surface 12, with chalk lines applied to the mounting surface 12, with other alignment markers, or with previously-installed tiles 20. One or more fasteners may then be driven through the fastener points 30 of the first tile 14 into the mounting surface 12.

The second tile 16 may then be assembled to the first tile 14 by placing the side lap 42 over the water channel 40 of the first tile 14. The second tile 16 is horizontally aligned within the limits imposed by the water channel 40 and the side lap 42. The channel notch 58 and the lap notch 59 cooperate to maintain the minimum horizontal exposure and the channel lip 56 maintains the maximum exposure. Fasteners may then be inserted to lock the second tile 16 to the mounting surface 12.

The third tile 18 may then be aligned to the first tile 14 and the second tile 16. The locking members 34 of the third tile 18 may be interlocked with the receiving members 32 of the first tile 14 and the second tile 16. Note that if the second tile 16 were incorrectly installed, such that the side lap 42 of the second tile 16 does not overlap the water channel 40 of the first tile 14, the receiving members 32 of the first tile 14 and the second tile 16 will be spaced too far apart to allow the locking members 34 of the third tile 18 to interlock therewith.

The horizontal and vertical alignment of the third tile 16 will be limited by the ability of the locking members 34 and the receiving members 32 to interlock. The third tile 16 is oriented such that the first tile 14 and the second tile 16 have nearly maximum vertical exposure. Fasteners may then be inserted to lock the upper edge 26 of the third tile 18 to the mounting surface 12. Interlocking between the locking members 34 of the third tile 18 and the receiving members 32 of the first tile 14 and the second tile 16 will hold the lower edge 28 of the third tile 18 to the mounting surface.

The detailed description and the drawings or figures are supportive and descriptive of the invention, but the scope of the invention is defined solely by the claims. While some of the best modes and other embodiments for carrying out the claimed subject matter have been described in detail, various alternative designs, configurations, and embodiments exist for practicing the invention defined in the appended claims.

The invention claimed is:

1. A multi-tile system configured for attachment to a mounting surface with a plurality of fasteners, comprising:

a first tile having:

an upper portion configured to be oriented upward relative to the mounting surface and a lower portion configured to be oriented downward relative to the mounting surface;

a first receiving member formed on an exterior side of the upper portion;

a second receiving member formed on an exterior side of the upper portion, wherein the first receiving member and the second receiving member are offset from the exterior side by respective vertical walls and include cantilevered portions that define horizontally open slots, and wherein the horizontally open slots of the first receiving member and the second receiving member are inwardly facing and are bounded by the vertical walls;

a water channel formed between the upper portion and the lower portion; and at least one fastener point formed on the upper portion and configured to attach the upper portion of the first tile to the mounting surface with at least one of the fasteners;

a second tile having:

an upper portion configured to be oriented upward relative to the mounting surface and a lower portion configured to be oriented downward relative to the mounting surface;

a first receiving member formed on an exterior side of the upper portion;

a second receiving member formed on an exterior side of the upper portion, wherein the first receiving member and the second receiving member include are offset from the exterior side by respective vertical walls and cantilevered portions that define horizontally open slots, and wherein the horizontally open slots of the first receiving member and the second receiving member are inwardly facing and are bounded by the vertical walls;

a side lap overlapping the water channel of the first tile; and at least one fastener point formed on the upper portion and configured to attach the upper portion of the second tile to the mounting surface with at least one of the fasteners; and a third tile having:

an upper portion configured to be oriented upward relative to the mounting surface and a lower portion configured to be oriented downward relative to the mounting surface, wherein the lower portion of the third tile overlaps the upper portion of the first tile and the upper portion of the second tile; and two locking members formed on an interior side of the lower portion and each including a vertical wall having a cantilevered portion extending from the vertical wall, wherein the cantilevered portions define horizontally open slots, such that the horizontally open slots are inward facing and are bounded by the vertical walls of the two locking members;

wherein one of the two locking members of the third tile interlock with one of the first receiving member and the second receiving member of the first tile and the other of the two locking members interlocks with one of the first receiving member and the second receiving member of the second tile, wherein the lower portion of the third tile is not directly attached to the mounting surface via the fasteners.

2. The multi-tile system of claim 1, wherein the receiving member of the first tile and the receiving member of the second tile cooperate with the two locking members of the third tile to define a vertical range of continuous vertical adjustment between the first tile and the third tile.

3. The multi-tile system of claim 2, wherein the locking members of the third tile are horizontally spaced apart by a locking span between the vertical walls of the locking members;

wherein the first receiving member of the first tile is spaced from a horizontal edge of the first tile by a first offset and the second receiving member of the second tile is spaced from a horizontal edge of the second tile by a second offset; and wherein the locking span is smaller than the sum of the first offset and the second offset.

4. The multi-tile system of claim 3, wherein the water channel of the first tile and the side lap of the second tile cooperate to define a horizontal range of continuous horizontal adjustment between the first tile and the second tile.

5. The multi-tile system of claim 4, further comprising:

a horizontal dam formed in the water channel of the first tile; and a horizontal ledge formed on the side lap of the second tile, wherein the horizontal dam of the first tile and the horizontal ledge of the second tile cooperate to create a serpentine path between the upper portion and the lower portion of the first tile.

6. The multi-tile system of claim 5, further comprising:

a channel notch formed in the upper portion of the water channel of the first tile; and a lap notch formed in the upper portion of the side lap of the second tile, wherein the channel notch of the first tile and the lap notch of the second tile cooperate to define a minimum horizontal exposure of the first tile.

7. The multi-tile system of claim 6, wherein the first tile is formed as a unitary, one-piece component, and the second tile is formed as a unitary, one-piece component.

8. The multi-tile system of claim 1, further comprising:

a channel notch formed in the upper portion of the water channel of the first tile; and a lap notch formed in the upper portion of the side lap of the second tile, wherein the channel notch of the first tile and the lap notch of the second tile cooperate to define a minimum horizontal exposure of the first tile.

9. The multi-tile system of claim 1, further comprising:

a horizontal dam formed in the water channel of the first tile; and a horizontal ledge formed on the side lap of the second tile, wherein the horizontal dam of the first tile and the horizontal ledge of the second tile cooperate to create a serpentine path between the upper portion and the lower portion of the first tile.

* * * * *